United States Patent [19]

Marshall et al.

[11] 3,988,086

[45] Oct. 26, 1976

[54] MELT SPINNING APPARATUS WITH CONVERGENCE GUIDE

[75] Inventors: Robert Moore Marshall, Chester; Eugene Addison Swanson, Disputanta, both of Va.

[73] Assignee: Allied Chemical Corporation, Morris Township, N.J.

[22] Filed: May 1, 1975

[21] Appl. No.: 573,664

Related U.S. Application Data

[62] Division of Ser. No. 505,183, Sept. 11, 1974.

[52] U.S. Cl. ..... 425/72 S; 242/157 R; 264/210 F; 425/94

[51] Int. Cl.[2] ..... D01D 11/04

[58] Field of Search ..... 425/94, 104, 455 F, 425/66, 72 S; 242/157 R; 264/176 F, 210 F

[56] References Cited

UNITED STATES PATENTS

| | | | |
|---|---|---|---|
| 2,373,078 | 4/1945 | Kleist | 242/157 R X |
| 3,041,663 | 7/1962 | Green | 425/66 X |
| 3,353,210 | 11/1967 | Herring | 242/157 |

*Primary Examiner*—Robert D. Baldwin
*Attorney, Agent, or Firm*—Fred L. Kelly

[57] ABSTRACT

It has been suggested that synthetic multifilamentary yarns can be produced by melt-spinning a polyamide or polyester polymer under conditions of substantially simultaneous spinning and drawing wherein prior to said drawing the filaments of the fiber are lubricated with a spin finish by surface contact with a lube roll surface of not less than about 90 RMS. However, in commercial operation of the process at high throughput rates of 50 pounds per hour or greater through the spinneret, serious problems have been encountered due to "flicking" or momentary slackness of one or more filaments from the main yarn bundle above the lube roll, which flicking results in production of yarn of relatively poor quality. It has now been found that the occurrence of said flicking of the filaments can be greatly reduced by applying the spin finish from a convergence guide having a yarn-lubricating surface of not less than about 10 RMS and means for distributing a film of lubricant over said surface. The resulting high-strength multifilament yarn having relatively uniform quality is particularly applicable for tire and industrial uses.

2 Claims, 4 Drawing Figures

MELT SPINNING APPARATUS WITH CONVERGENCE GUIDE

This is a division, of Application Ser. No. 505,183, filed Sept. 11, 1974.

BACKGROUND OF THE INVENTION

This invention relates to an improved apparatus for production of synthetic multifilamentary yarns having uniform quality from high molecular weight linear polymers, in particular polyamides and polyesters, according to an improved melt spinning process.

An important area of use of such synthetic multifilamentary yarns is the production of tire cord. A number of high polymers are well suited for this utility, especially polyesters and polyamides; however, in the following description reference will be made particularly to filaments of polyethylene terephthalate.

Since tire cord and the structures formed from it are among the essential construction elements for the safety and useful life of a tire, high quality requirements are naturally placed on such endless filaments. In view of the alternating stretching and compression stresses which tires experience in operation, a necessary precondition for the use of synthetic multifilamentary yarns for tire cord is an adequate fatigue resistance of the filaments. For optimum results, it is critical that the individual filaments be substantially uniform. Accordingly, it is common practice to determine the coefficient of variation of the evenness of the yarn (U %) using an Uster evenness tester as manufactured by the Zellweger Company of Uster, Switzerland, and described in "Handbook of Textile Testing and Quality Control" by E. Groover and D. S. Hamby.

The production of polyester yarns useful for tire, textile and industrial purposes is well known. In many of the prior art methods, the spinning and drawing and twisting of the filaments are separately carried out. However, several processes have been developed which involve conditions of continuously spinning and drawing filaments.

U.S. Pat. No. 3,433,008 to T. B. Gage discloses production of a bulked yarn by a process comprising applying a finish of an ester of polyethylene glycol of molecular weight between 150 and 600 and an aliphatic carboxylic acid to continuous melt spun filaments before the filaments are drawn. The filaments are then drawn and bulked in a turbulent fluid jet to give the bulked yarn.

U.S. Pat. No. 3,511,677 to A. J. Strohmaier et al. discloses preparation of a sized zero-twist synthetic fiber yarn by a process comprising applying a coating of a volatile medium containing a thermoplastic filmforming polymeric material to an undrawn yarn, drawing the yarn while wet with the volatile medium and then heating the drawn yarn to dry the coating before winding the yarn on a package.

U.S. Pat. No. 3,793,425 to R. J. Arrowsmith discloses a process for pretreating polyester filamentary material for subsequent rubber adhesion, the process comprising extruding a polyester filamentary material capable of being drawn and before the extrudate is fully drawn, coating with a composition containing an epoxy resin.

More recently, it has been suggested that a high strength polyester fiber can be produced by melt-spinning a polyester polymer under conditions of substantially simultaneous spinning and drawing wherein prior to said drawing the filaments of the fiber are lubricated by surface contact with a lube roll surface of not less than about 90 RMS. However, in commercial operation of said process at high throughput rates of 50 pounds per hour or greater through the spinneret, serious problems have been encountered due to "flicking" of filaments from the main yarn bundle above the lube roll, which flicking results in production of yarn of relatively poor quality. "Flicking" has been particularly troublesome in so-called double-end melt spinning of synthetic fibers, i.e., using one spin pot to feed both sides of a "split" spinneret. Accordingly, research has been continued in an effort to solve these deficiencies.

The term "RMS," which is short for root-mean-square, is an arbitrary measurement of surface texture and is described in detail in the publication, Surface Texture (ASA B 46.1 - 1962), The American Society of Mechanical Engineers, United Engineering Center, 345 East 47th Street, N.Y. 17, New York, page 16 (1962). Such measurement is utilized throughout this invention disclosure unless otherwise stated.

The term "flicking" is conventionally applied and is used herein to mean a momentary slackness of a filament in the undrawn yarn above the lube zone. The slack filament bows out of phase from the main bundle, thus "flicking". It is known that excessive "flicking" normally causes production of yarn of relatively low quality having an excessive number of defects such as missing filaments, filament breaks and loops.

SUMMARY OF THE INVENTION

The present invention relates to an improved melt-spinning apparatus for preparing synthetic multifilamentary yarns having uniform quality. The invention particularly relates to an improved melt-spinning process which involves applying a protective spin finish to the synthetic multifilamentary yarns by use of a novel lubricating and yarn-converging device, whereby "flicking" of the filaments from the main yarn bundle above the lubricating zone is substantially reduced or eliminated and the product yarns have improved quality.

These advantages are provided, in apparatus for melt spinning a large number of filaments at high speed from a spinneret, wherein said filaments are cooled, converged into a bundle and a protective spin-finish is applied before the filaments are drawn, by the improvement of a convergence guide having an essentially rectilinear primary yarn-contacting surface of smoothly-rounded contour for converging the filaments into a flat bundle and contiguous yarn-contacting surfaces of smoothly-rounded contour for controlling the width of the yarn bundle, and, in combination therewith, means for distributing a uniform film of lubricant over said primary yarn-contacting surface, which surface is defined as having a surface of at least 10 RMS, preferably 20 to 200 RMS.

The process of the present invention may be summarized as follows. In a process for the production of a synthetic multifilamentary yarn from a high-molecular weight thermoplastic polymer, selected from the group consisting of linear polyester and polyamide polymers, by melt-spinning, including the steps of applying a melt of said polymer at a temperature below the spinning temperature, and heating the melt to spinning temperature prior to filament formation, the improvement which comprises:

a. extruding the molten synthetic polymer at a rate of at least 50 pounds per hour downwardly through a spinneret having a plurality of extrusion orifices;

b. advancing the extruded filaments downwardly through a substantially stationary column of air having a temperature of 100° to 330° C. immediately below the spinneret, the average distance between adjacent filaments immediately below the spinneret being at least 0.24 inch, preferably 0.28 to 0.4 inch;

c. subsequently advancing the filaments downwardly through a quenching zone wherein they are in contact with cooling air introduced into the path of the filaments, said air contacting the filaments at a volumetric rate of 100 to 800 cubic feet of air per pound of filaments entering the quenching zone; and d. simultaneously lubricating the cooled filaments and converging said filaments into a yarn bundle of uniform essentially rectilinear cross-section by drawing said filaments into contact with a grooved convergence guide having an essentially rectilinear primary yarn-contacting surface of smoothly-rounded contour for converging the filaments into a flat bundle and contiguous yarn-contacting surfaces of smoothly-rounded contour for controlling the width of the yarn bundle, and in combination therewith, means for distributing a uniform film of lubricant over said primary yarn-contacting surface, which surface is defined as having a surface of at least 10 RMS.

The lubricated filaments may be drawn in accordance with prior art processes which involve the following steps:

a. heating said filaments substantially immediately above their second order transition temperature;

b. drawing said filaments substantially instantly at a temperature in the range of from about above their second order transition temperature to within about 5° -methylene-bis-(C. of their melting point;

c. compacting said filaments sufficiently for subsequent processing of said filaments; and d. winding up said filaments.

It will be understood that the drawing steps are conventional and can be modified if desired. For example, the yarn may be drawn on a seven roll panel or on a four roll panel. However, regardless of panel set up, the draw panel process steps preferably involve pretensioning to provide yarn stability on the rolls, feed rolls to provide constant yarn supply to the draw zone, a draw point localizer to provide draw-down point in the draw zone, draw rolls to maintain constant draw ratio and relax rolls to provide for control of yarn physical properties. Optionally, a yarn compaction jet may be used before or after the relax rolls to provide yarn entanglement.

Surprisingly, in operation of the process of the present invention, "flicking" of filaments from the main yarn bundle above the lube zone is significantly reduced with a corresponding marked decrease in product defects.

DESCRIPTION OF THE PREFERRED EMBODIMENT

Figure 1:
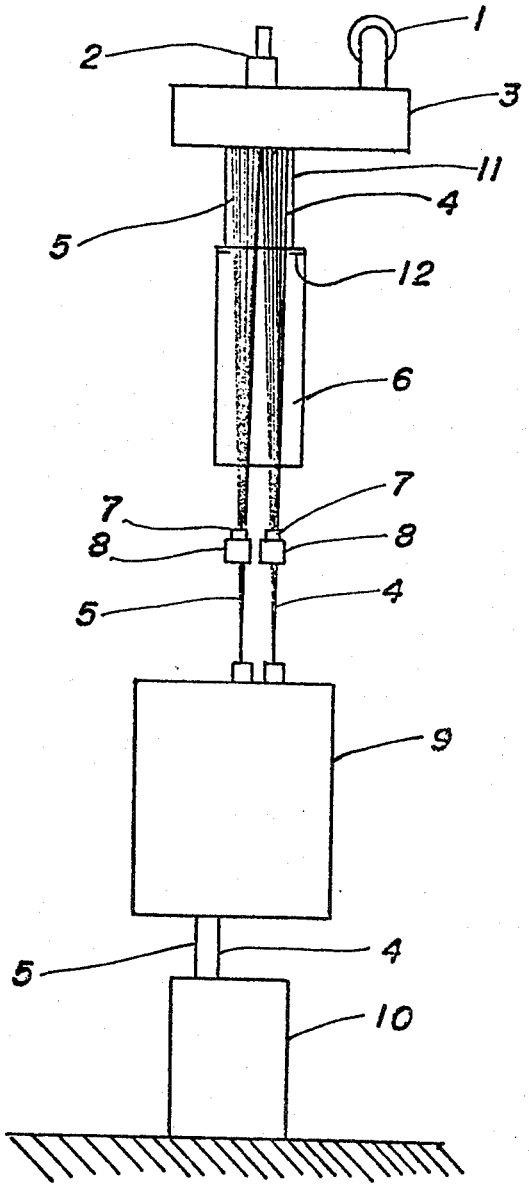
FIG. 1 is an over-all schematic diagram of the spinning apparatus showing location of the convergence guide of this invention.

It has now been found that synthetic multifilament yarn, e.g., polyethylene terephthalate multifilament yarn, including such yarn of high denier per filament, e.g., 20 to 50 denier per filament (undrawn) can be melt spun continuously from a single spinneret at high production rates such as 50 to 90 pounds per hour, and this yarn can be continuously drawn without an intermediate step of winding up, at draw ratios of at least 4:1. These results are achieved in accordance with this invention, by employing controlled conditions whereby the "flicking" of filaments from the yarn bundle above the lube zone is not above 10 per minute. More specifically, in accordance with the present process, a relatively large number of heavy filaments are extruded downwardly into a substantially stationary column of air having a temperature of 100° to 330° C. and a height of from 0.5 to 2 feet, preferably 1 to 1.5 feet, immediately below the spinneret, the distance between adjacent filaments immediately below the spinneret being preferably 0.28 to 0.4 inch, and subsequently advancing the filaments through a quenching zone wherein they are contacted with cooling air entering the zone at a volumetric flow rate of 100 to 800, preferably 200 to 700 cubic feet of air (measured at standard temperature and pressure) per pound of entering filaments, the air being at inlet temperature not above 35° C.

Preferably, the cooled filaments are converged into a yarn bundle of uniform essentially rectilinear cross-section and simultaneously lubricated by a protective spinning finish composition, preferably at a temperature of 20° to 60° C., by drawing said filaments into contact with a grooved convergence guide having an essentially rectilinear primary yarn-contacting surface of smooth-rounded contour for converging the filaments into a flat bundle and contiguous yarn-contacting surfaces of smoothly-rounded contour for controlling the width of the yarn bundle, and in combination therewith, means for distributing a uniform film of lubricant over said primary yarn-contacting surface, which surface is defined as having a surface of at least 10 RMS, preferably 20 to 200 RMS.

A conventional spinning finish composition is used to lubricate the filaments. A typical finish comprises a lubricant and may contain a diluent, an antistatic compound, an emulsifier and a wetting agent. For example, excellent results have been obtained when the filaments are coated with from about 0.3 to about 0.6 weight percent based on the weight of the yarn of a liquid composition consisting essentially of about 10 to about 20 weight percent of said composition of each hexadecyl stearate and refined coconut oil, about 3.0 to about 6.0 weight percent of said composition of ethoxylated tallow amine, about 10 to about 20 weight percent of said composition of ethoxylated lauryl alcohol, about 8.0 to about 12.0 weight percent of said composition of sodium salt of alkylarylsulfonate, about 1.0 to about 3.0 weight percent of said composition of dinonylsodium-sulfosuccinate, about 1.0 to about 3.0 weight percent of said composition of an antioxidant selected from the group consisting of 4,4'-butylidene-bis-(28 6-tert-butyl-m-cresol), thio-bis-(di-sec-amylphenol), trinonyl phenol phosphite, and 2,2-methylenebis-(4-methyl-6-tert-nonylphenol), about 35 to 50 weight percent of said composition of white mineral oil having a boiling point of between 510° F. and 620° F.

Preferably, the viscosity of the finish composition is maintained at about 10 to 100 centipoises, measured at the temperature of application.

One preferred embodiment of this invention is directed to an improved melt spinning process and apparatus involving double-end spin-draw and take-up for multifilament synthetic polymer fibers.

In order to demonstrate the invention, the following examples are given. They are provided for illustrative purposes only and are not to be construed as limiting the scope of the invention, which is defined by the appended claims. In these examples, parts and percentages are by weight unless otherwise indicated. The intrinsic viscosity of the polyester is given as a measure for the mean molecular weight, which is determined by standard procedures wherein the concentration of the measuring solution amounts to 0.5 g/100 ml., the solvent is a 60 percent phenol-40 percent tetrachloroethane mixture, and the measuring temperature is 25° C. In the examples, the diameter fluctuations along an unstretched bundle of filaments serve as a measure of uniformity. For high quality yarn, it is important that the filaments be substantially uniform. Accordingly, the coefficient of variation of the evenness (U %) is determined using an Uster evenness tester manufactured by the Zellweger Company of Uster, Switzerland and described in "Handbook of Textile Testing and Quality Control" by E. Groover and D. S. Hamby.

EXAMPLE 1

A melt of polyethylene terephthalate having an intrinsic viscosity of about 0.92 was supplied at a rate of 60 pounds per hour, at a temperature of about 291° C., to the apparatus shown in FIGS. 1 to 4. The molten polymer was fed by extruder 1 to spinning pump 2 which fed spinning block 3 containing a conventional spinning pot comprising a spinning filter and a spinneret, the spinning filter being disposed between the spinning pump and the spinneret. The spinning filter consisted of a conventional sieve filter combination of 24 metal screen layers. The pressure drop through said spinning filter averaged 200 to 400 atmospheres. The spinning pot was enclosed in a controlled high temperature atmosphere so that loss of heat from the polymer was minimized. The melt enthalpy increase through the pump and sieve filter was sufficient to heat the melt at a point immediately above the spinneret to about 305°–310° C., and the pressure at this point was about 50 atmospheres. The flow of polymer through the spinneret was maintained at a constant rate of 60 pounds per hour by spinning pump 2.

The spinning pot spinneret was divided into two parts by means of an undrilled "stripe" wide enough to form a visible split between the multiple ends below the spinneret. The spinneret plate had 384 holes (192 holes on each side of the undrilled stripe), each of 0.018 inch diameter, spaced so that the distance between the filaments formed was 0.28 to 0.40 inch immediately below the spinneret.

From said spinneret there was extruded two ends 4–5 of multifilament, continuous filament yarn, and the two ends were passed downwardly into a substantially stationary column of air contained in a heated sleeve 11, about 15 inches in height, disposed immediately beneath the spinneret. The air temperature in the heated sleeve was maintained at about 300° C. at the top of the sleeve, decreasing to about 115° C. at the bottom. The temperature of the metal in the heated sleeve was about 330° C. at the top and 220° C. at the bottom of the sleeve. The minimum distance between filaments at the bottom of the heated sleeve was about 0.24 inches. A heated sleeve baffle 12 was provided at the bottom of the heated sleeve forming an inwardly extending flange to minimize flow of cooling air into the heated sleeve.

Yarn leaving the heated sleeve was passed directly into the top of a quenching chamber in quenching chimney 6. The quenching chimney was an elongated chimney 70 inches in height, substantially rectangular in cross-section and provided with imperforate top, rear and side walls. The front of the chimney was partially covered by an imperforate door which terminated about 17.5 inches short of the top wall and presented an open passage for air discharging from the chimney. The interior of the quenching chimney was partitioned by a perforated distribution plate which formed the boundary between a plenum chamber and the quenching chamber. Quenching air at about 25° C. and 65% relative humidity was supplied to the plenum chamber at about 200 cubic feet of air per pound of filaments entering the quenching chamber.

The two ends 4–5 of multifilament, continuous filament yarn were advanced downwardly through said quenching chamber wherein they were in contact with the cooling air introduced into the path of the filaments. The temperature of the cooled yarn at the bottom of the quenching chamber was about 40°–50° C.

Figure 2:
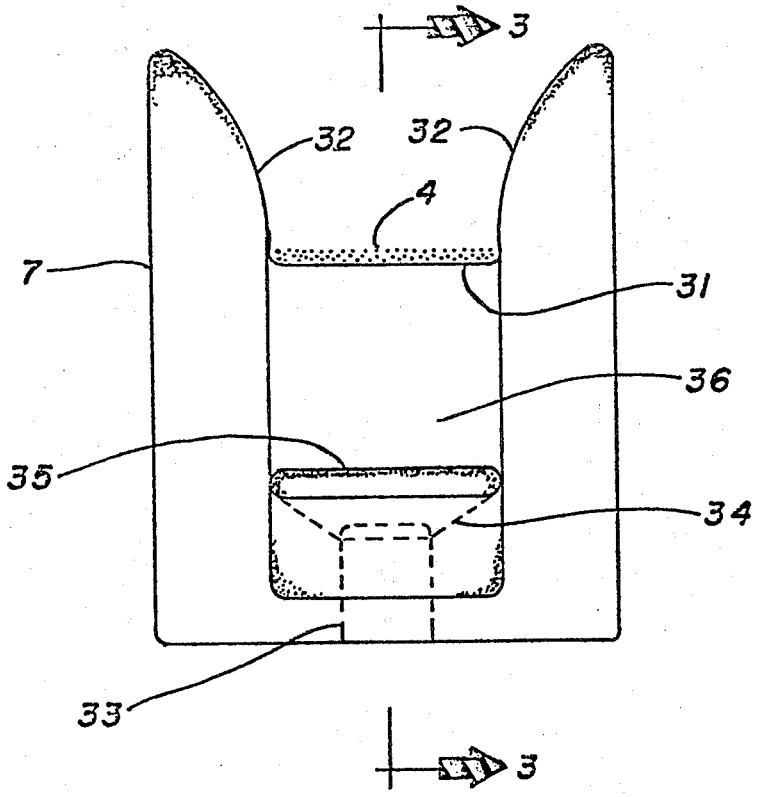
FIG. 2 is a plan view of a preferred embodiment of the convergence guide of this invention.
Figure 3:
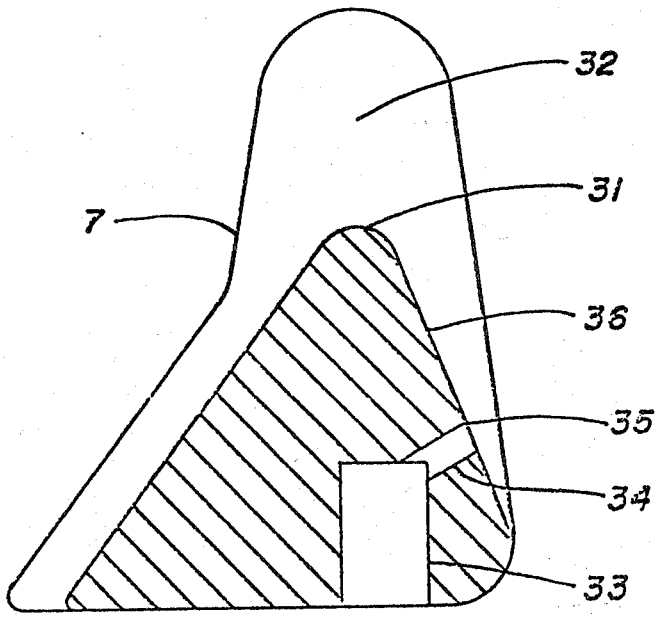
FIG. 3 is a sectional elevation taken on line 3—3 of FIG. 2.

Following quenching, the filaments were lubricated and converged by drawing said filaments into contact with convergence guides 7 shown in detail in FIGS. 2 and 3. The primary yarn-contacting surface 31 of the ceramic convergence guides used had a surface of 20–40 microinches RMS. A constant finish temperature of about 50° C. was maintained. The viscosity of the finish was about 13 centipoises at the temperature of application. About 0.3 to 0.4 weight percent of the finish composition was applied to the yarn based on the weight of the yarn. Convergence guides 7 have means for connection to finish composition source, not shown, and means for distributing a uniform film of lubricant over primary yarn-contacting surface 31.

| Finish Components | Parts | Function |
|---|---|---|
| Refined coconut glyceride | 14.7 | Lubricant |
| Hexadecyl stearate | 14.7 | Lubricant |
| Ethoxylated lauryl alcohol (4 EO) | 12.7 | Emulsifier |
| Sodium petroleum sulfonate 60-62% active in mineral oil | 9.8 | Antistat emulsifier |
| Ethoxylated tallow amine (20 EO) | 4.9 | Antistat emulsifier |
| Sodium salt of sulfonated succinic ester | 2.0 | Wetting agent |
| "Naugawhite" (2,2-methylene-bis-(4-methyl-6-tert-nonylphenol) | 2.0 | Antioxidant |
| Mineral oil viscosity 40 SSU | 39.2 | Continuous phase |

Each convergence guide 7, mounted in fixed support 8, is set forward of the threadline such that the filaments slide across the primary yarn-contacting surface 31 as indicated by the layer of filaments 4 in FIG. 2. Convergence of the filaments within the substantially vertical plane which includes the yarn-contacting surface of the convergence guide continues beyond the guide as shown in FIG. 1. The coefficient of variation of the evenness of the undrawn yarn (U %) was not above 10 over an extended period of operation.

In this example, "flicking" of filaments from the main yarn bundle above the lube zone was observed at intervals over an extended period of operation. For testing purposes, flicking was arbitrarily defined as any movement of a filament greater than 0.25 inch from the main bundle. The point of measurement was arbitrarily selected at 3 inches above the main bundle. Any movement of filaments greater than 0.25 inch were counted for a period of 5 minutes. The average number of "flicks" was less than 0.5 per minute. Thus, the prior art problem of "flicking" was substantially eliminated.

Figure 4:
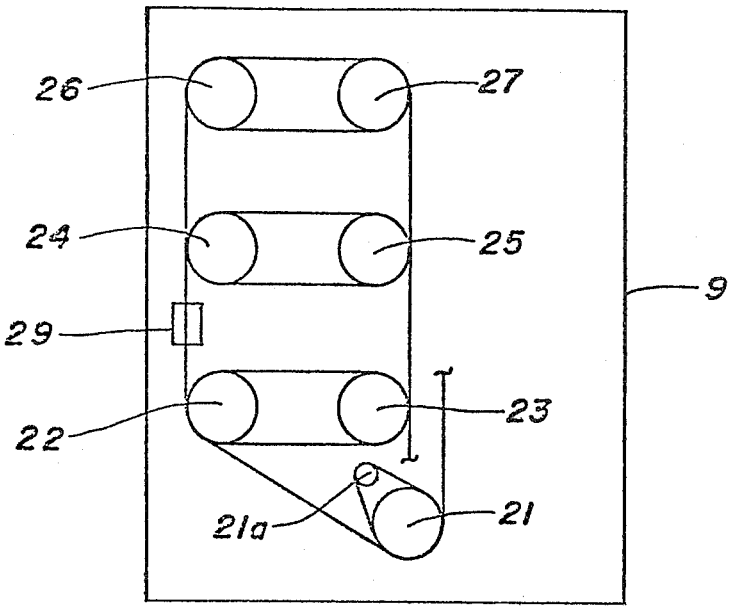
FIG. 4 is a schematic of a two end embodiment of the draw panel labeled 9 in FIG. 1.

Following lubrication, the ends 4–5 were passed to draw panel 9, shown in detail in FIG. 4. As shown in FIG. 4, the yarn was passed to pretension roll 21 with its accompanying separator roll 21*a*. The yarn was then passed over cold feed roll pair Godet rolls 22 and 23, then through a draw point localizer 29 which was a conventional steam jet, then to a draw roll pair of Godet rolls 24 and 25 operated to about 145° C. and traveling at a speed 5.0 to 6.6 times faster than the feed roll, then to a relaxation pair of Godet rolls 26 and 27, and optionally through an entangling apparatus such as a conventional air operated interlacing jet, and on to winder 10 as shown in FIG. 1. Typical yarn prepared at a draw ratio of 6 had the following properties:

| | |
|---|---|
| Denier | 1,000 |
| Tenacity, g/d | 9.25 |
| Elongation, % | 13.5 |
| Shrinkage, % | 9.5 |
| B. Q. I. | <90 |

The term "beaming quality index" (B.Q.I.) is defined as defects (broken filaments, strip backs, nubs, etc.) per million yards in beaming of yarn.

It will be understood that the above-described draw panel can be modified if desired. For example, the yarn may be drawn on a seven roll panel or on a four roll panel. However, regardless of panel set up, the draw panel process steps involve pretensioning to provide yarn stability on the rolls and on entry of the yarn into the draw point localizer steam jet, feed rolls to provide constant yarn supply to the draw zone, a draw point localizer to provide drawdown point in the draw zone, draw rolls to maintain constant draw ratio and relax rolls to provide for control of yarn physical properties. Optionally, a yarn compaction jet may be used before or after the relax rolls to provide yarn entanglement.

FIGS. 2 and 3 are, respectively, plan and cross-sectional elevation views of the preferred convergence guide of the present invention, which guide was used in this example. As shown in FIG. 1, two convergence guides were used for the two fiber ends; however, in the following description reference will be made particularly to the guide used for the filaments of end 4 of FIG. 1, the other guide being substantially identical.

FIG. 2 shows a schematic representation of the approximate distribution of filaments of end 4 in the bundle cross-section during yarn production. This embodiment has one essentially rectilinear primary yarn-contacting surface 31 of smoothly-rounded contour for converging the filaments of end 4 into a flat bundle, and two contiguous yarn-contacting surfaces 32 of smoothly-rounded contour for controlling the width of said yarn bundle. The spinning finish is fed into the convergence guide 7 by means of spinning finish inlet 33 and led upwardly through conduit 34 to a slot 35 which feeds the finish onto a downwardly-sloping weir 36. The spinning finish flows by gravity from slot 35 downwardly over the downwardly-sloping weir 36 to the primary yarn-contacting surface 31 where it is uniformly distributed onto the filaments of end 4. The sectional elevation 3—3 of FIG. 2 of this embodiment is shown in FIG. 3. Like numbers in FIG. 3 correspond to like elements in FIG. 2.

EXAMPLE 2

The procedure of Example 1 was followed except that the heated sleeve baffle at the bottom of the heated sleeve was opened so that there was no longer a substantially stationary column of air in the heated sleeve. The extent of "flicking" increased to greater than 60 "flicks" per minute, and high quality yarn could not be produced. In other tests, it was demonstrated that optimum results are obtained when the heated sleeve baffle is used and the air temperature in the heated sleeve is maintained at about 300° C. at the top of the sleeve, decreasing to about 115° C. at the bottom of the sleeve.

EXAMPLE 3

The procedure of Example 1 was followed except that the filaments advancing through the quenching zone were contacted with cooling air entering the zone at 100 cubic feet of air (measured at standard temperature and pressure) per pound of entering filaments. (In Example 1, cooling air entered the zone at 200 cubic feet of air per pound of filaments). In this test no significant decrease in flicking was observed; however, quenching was considered inadequate because predrawing began to occur. When the filaments were contacted with cooling air at rates higher than 700 cubic feet of air per pound of filaments, the number of "flicks" per minute were increased to greater than 5. Accordingly, it is generally desirable for the cooling air to enter the zone at 200–700 cubic feet of air per pound of entering filaments.

Discussion

It is important that the above-described process of the present invention permits a significant increase in production capacity of a polymer spinning operation. In some cases, it is practical to convert a single-end fiber plant to double-end plant with only simple changes in the original equipment, the yarn production being increased for example by a factor of 2. Also, the present invention substantially overcomes problems of poor yarn quality such as the formation of fused filaments, loose filament loops and broken filaments.

The present invention is particularly useful for economical production of polyamide and polyester tire and industrial yarn. By "polyamide" is meant the polymers made by condensation of diamines with dibasic acids or by polymerization of lactams or amino acids, resulting in a synthetic resin characterized by the recurring group -CONH-. The preferred polyesters are the linear terephthalate polyesters, i.e., polyesters of a glycol containing from 2 to 20 carbon atoms and a dicarboxylic acid component containing at least about 75% terephthalic acid. The remainder, if any, of the dicarboxylic acid component may be any suitable dicarboxylic acid such as sebacic acid, adipic acid, isophthalic acid, sulfonyl-4,4'-dibenzoic acid, or 2,8-dibenzofuran-dicarboxylic acid. The glycols may contain more than two carbon atoms in the chain, e.g., diethylene glycol, butylene glycol, decamethylene glycol, and bis-1,4-(hydroxymethyl) cyclohexane. Examples of linear terephthalate polyesters which may be employed include poly(ethylene terephthalate), poly(butylene terephthalate), poly(ethylene terephthalate/5-chloroisophthalate) (85/15), poly(ethylene terephthalate/5-[sodium sulfo]isophthalate) (97/3), poly(cyclohexane-1,4-dimethylene terephthalate), and poly(cyclohexane-1,4-dimethylene terephthalate/hexahydroterephthalate) (75/25).

The materials of construction for the convergence guide of the present invention are not critical and may be selected from any materials that are known to be satisfactory for the preparation of conventional convergence guides, for example, steel or ceramic.

We claim:

1. In an apparatus for melt spinning a large number of filaments at high speed from a spinneret, wherein said filaments are cooled, converged into a bundle and a protective spinning finish is applied before the filaments are drawn, the improvement comprising a convergence guide having an essentially rectilinear primary yarn-contacting surface of smoothly-rounded contour for converging the filaments into a flat bundle and contiguous yarn-contacting surfaces of smoothly-rounded contour for controlling the width of the yarn bundle, and, in combination therewith, means for distributing a uniform film of lubricant over said primary yarn-contacting surface, wherein said primary yarn-contacting surface and said contiguous yarn-contacting surfaces of the convergence guide form a groove for converging the filaments into a bundle and said primary yarn-contacting surface has a surface of 20 to 200 RMS, and wherein said means for distributing a uniform film of lubricant over said primary yarn contacting surface comprises an inlet for feeding a spinning finish into said convergence guide, said inlet being connected to a conduit for leading the finish upwardly to a slot which feeds the finish onto a downwardly sloping weir, the finish flowing by gravity from said slot downwardly over the downwardly-sloping weir to the primary yarn-contacting surface.

2. The apparatus of claim 1 wherein said spinneret includes means for melt spinning filaments at a rate of at least 50 pounds per hour downwardly through said spinneret into a heated sleeve having a height of 1 to 1.5 feet, said heated sleeve containing a substantially stationary column of air having a temperature of 100° to 330° C., said heated sleeve having a heated sleeve baffle at the bottom of said heated sleeve forming an inwardly extended flange to minimize flow of cooling air into the heated sleeve, and a quenching chamber wherein a cross flow of cooling air is adapted to be introduced into the path of the filaments at a temperature not above 35° C. said cooling air contacting the filaments at a volumetric rate of 200 to 700 cubic feet of air per pound of filaments entering said quenching chamber.

* * * * *